US007475450B1

(12) United States Patent
Ragner

(10) Patent No.: US 7,475,450 B1
(45) Date of Patent: Jan. 13, 2009

(54) DUAL-BELT COUNTER-ROTATING DRIVE SYSTEM

(76) Inventor: Gary Dean Ragner, 711 SW. 75th St., #103, Gainesville, FL (US) 32607

( * ) Notice: Subject to any disclaimer, the term of this patent is extended or adjusted under 35 U.S.C. 154(b) by 558 days.

(21) Appl. No.: 11/299,449

(22) Filed: Dec. 10, 2005

Related U.S. Application Data

(60) Provisional application No. 60/635,402, filed on Dec. 11, 2004.

(51) Int. Cl.
*A47L 5/30* (2006.01)
*A47L 9/04* (2006.01)
*A47L 11/20* (2006.01)

(52) U.S. Cl. ..... 15/384; 15/391

(58) Field of Classification Search ..... 15/384, 15/385, 388, 389, 391, 309, 340.4; 474/7, 474/84, 85, 87, 139
See application file for complete search history.

(56) References Cited

U.S. PATENT DOCUMENTS 2,073,668 A * 3/1937 Wilson ..... 474/87
2,195,105 A * 3/1940 Watt ..... 474/85
6,866,603 B2 3/2005 Ackerman
7,150,068 B1 * 12/2006 Ragner ..... 15/340.2

* cited by examiner

*Primary Examiner*—David B Thomas

(57) ABSTRACT

A belt drive system for a mechanical cleaning device that require counter-rotating brushes and/or scrubbers, comprising two belts 42 and 44, a drive shaft 36, a pulley 32, and two rotary brushes 22 and 24. The first belt 44 engages drive shaft 36 and rotary brush 24 by friction contact and transfers rotary power from shaft 36 to rotary brush 24 through the rotation of belt 44. The second belt 42 engages pulley 32 and rotary brush 22 by friction contact so that they turn together. Pulley 32 is positioned relative drive shaft 36 so that the exterior surface of first belt 44 engages the exterior surface of second belt 42 by friction contact. Rotary power is thereby transferred from belt 44 to belt 42 by this friction contact between the two belts. Because the exterior of two belts 42 and 44 are in friction contact they must the must rotate in opposite directions and thereby drive rotary brushes 22 and 24 in opposite directions, respectfully.

12 Claims, 4 Drawing Sheets

DUAL-BELT COUNTER-ROTATING DRIVE SYSTEM

CROSS-REFERENCE TO RELATED APPLICATIONS

This utility application claims priority from U.S. Provisional application Ser. No. 60/635,402, filed on Dec. 11, 2004, titled: "Dual-Belt Counter-Rotating Drive System".

BRIEF DESCRIPTION OF INVENTION

The field of this invention relates to belt drive systems and more particularly to drive systems using two or more belts to drive counter-rotating agitators or brushes for cleaning.

BACKGROUND OF INVENTION

Cleaning devices that use dual agitator (brushes) for cleaning have been around for some time. Such devices have been used in vacuum cleaners, shampooers, floor scrubbers and more. In each case, the use of two or more rotary brushes rotating in opposite directions are used to clean surfaces. However, the transmission needed to provide counter-rotating agitators has been complex due to the opposite rotation of the brushes. Gears and other complex gear/belt systems have been tried with limited success. For systems where the rotary agitators (or rotary brushes) are positioned a considerable distance away from each other, a simple and durable answer was not found in the prior art.

The disclosed dual-rotor drive system provides counter-rotating brushes using a simple, durable, light-weight and compact belt drive system.

SUMMARY

The disclosed dual-belt counter-rotating drive system provides a simple design that requires no gears or other hard linkages. Instead the disclosed design uses two belts and a single pulley to generate the counter-rotating belts. This is accomplished by forcing the outside surfaces of the two belts into friction contact with each other so that one belt drives the other. The result is the belts rotate in opposite directions and can then be used to drive rotary brushes for cleaning.

OBJECTIVES AND ADVANTAGES

Accordingly, several objects and advantages of my invention are:

a) To provide a light-weight drive system for driving two counter-rotating agitator brushes.

b) To provide a durable drive system for driving two counter-rotating agitator brushes that does not use gears or gear boxes to produce the counter rotating drives.

c) To provide a durable drive system for driving two counter-rotating agitator brushes that is very tolerant of dirt and dust.

d) To provide a compact drive system for driving two counter-rotating agitator brushes that requires very little additional volume use.

e) To provide a two-belt system where one belt is driven directly by the output shaft of a motor, and the second belt is physically driven in the opposite rotary direction by contact with the outside surface of the first belt.

DRAWING FIGURES

Figures 1, 1A:
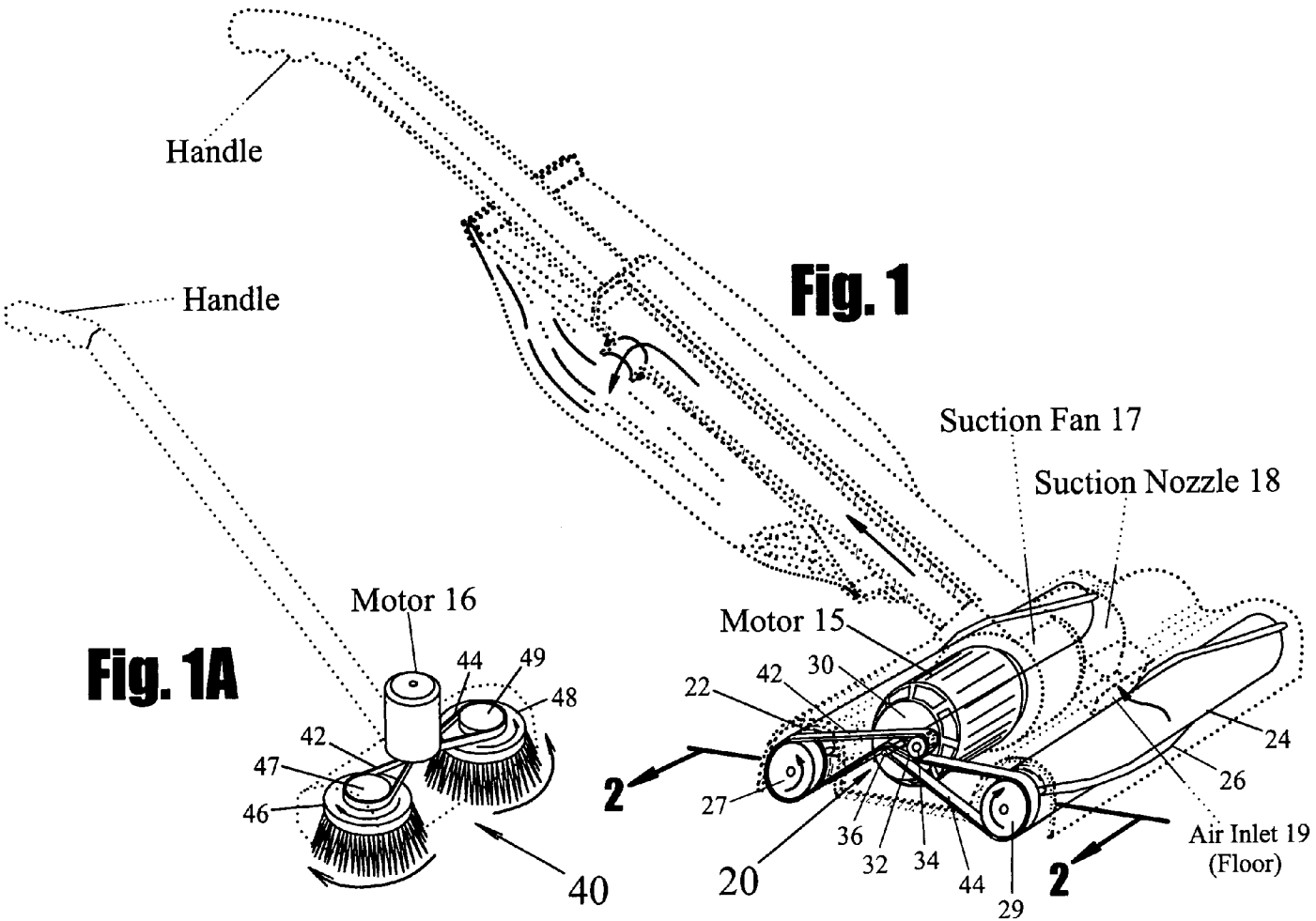

FIG. 1 Perspective view of a vacuum cleaner having a standard prior art construction with the disclosed dual-belt drive system 20 driving two rotary brushes.

FIG. 1A Perspective view of a floor scrubber having a standard prior art construction with the disclosed dual-belt drive system 40 driving two rotary brushes.

Figure 2:
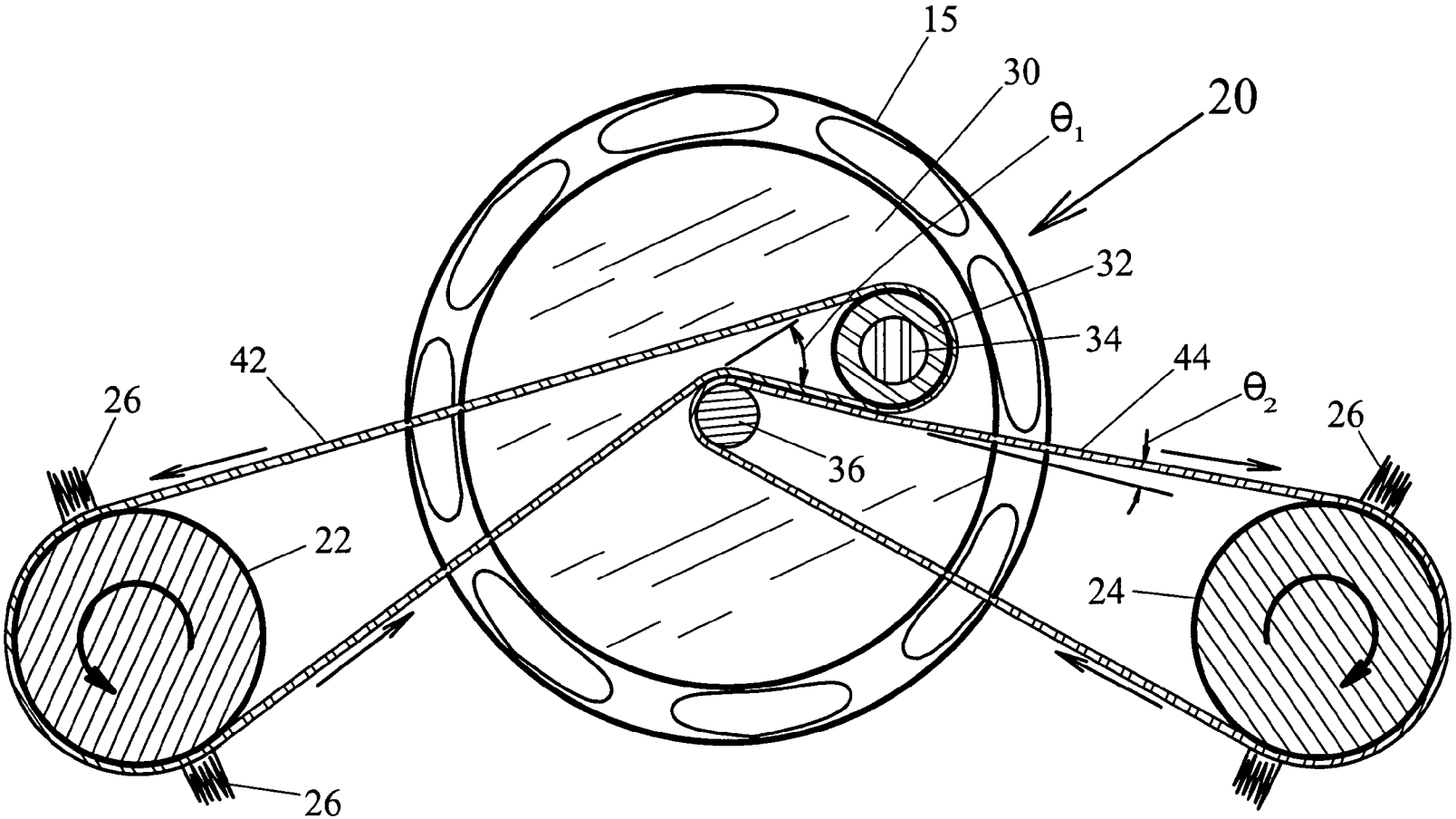

FIG. 2 Side section-view of the disclosed dual-belt system 20 and motor 15.

Figure 3:
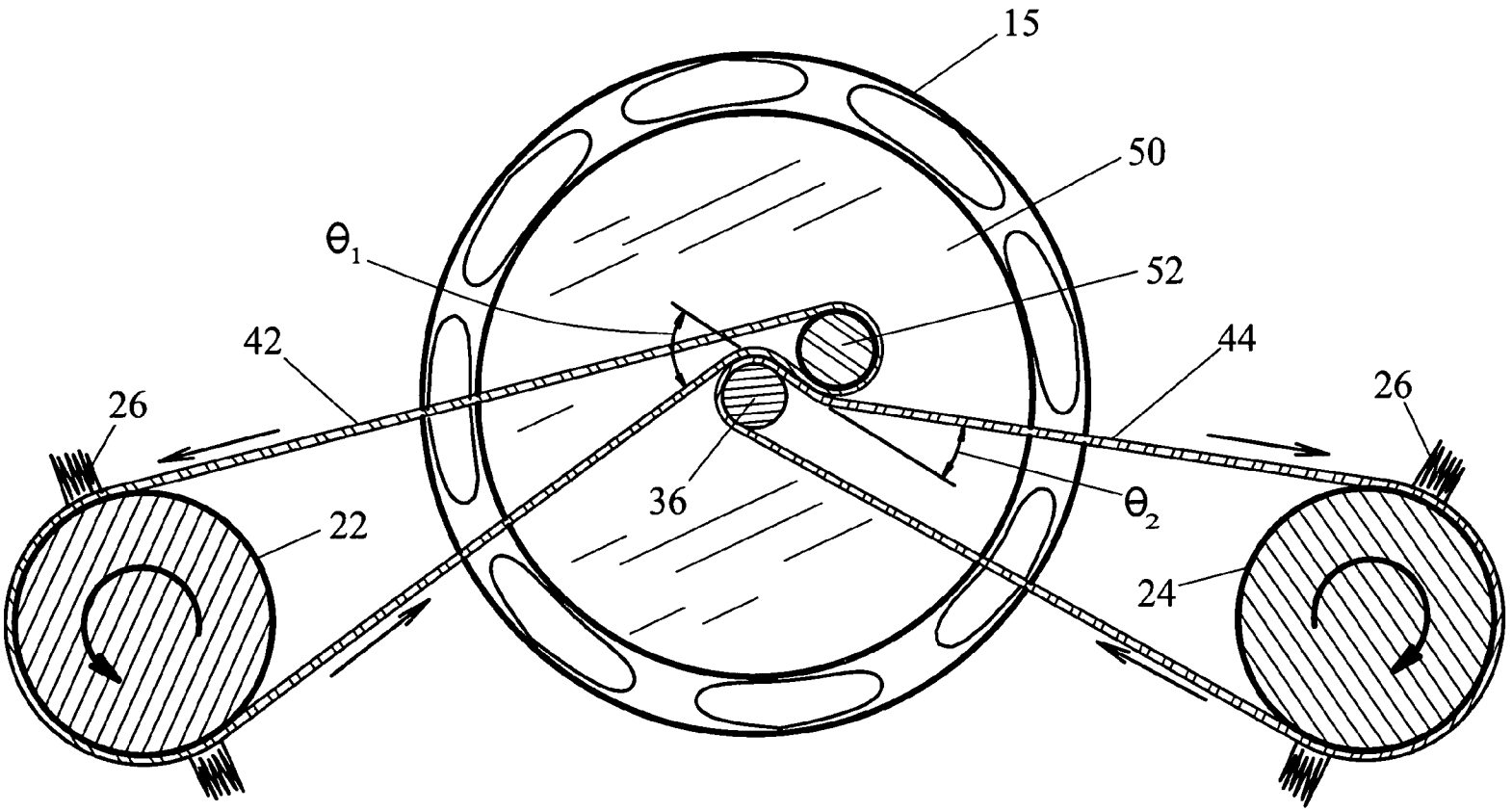

FIG. 3 Side section-view of an alternative dual-belt system and motor 15.

Figure 4:
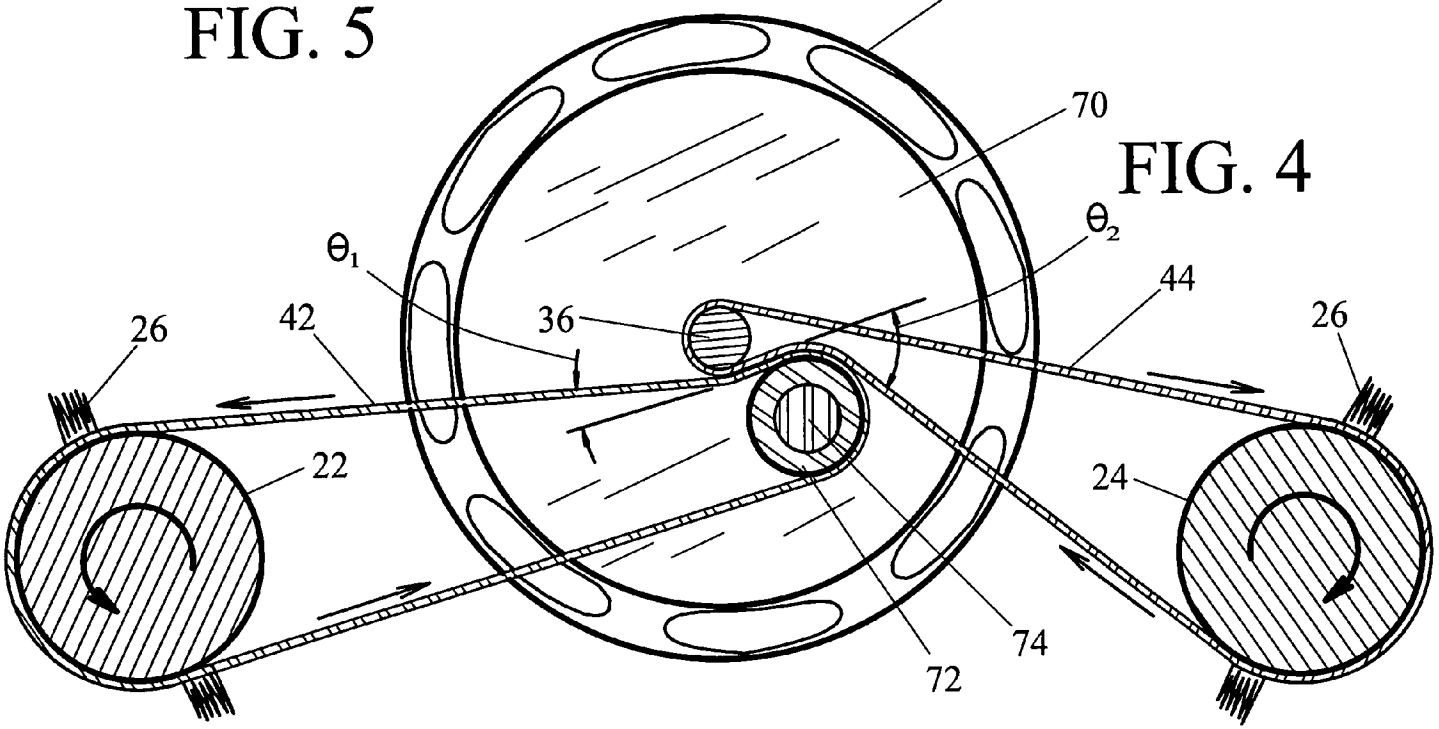

FIG. 4 Side section-view of a second alternative dual-belt system and motor 15.

Figure 5:
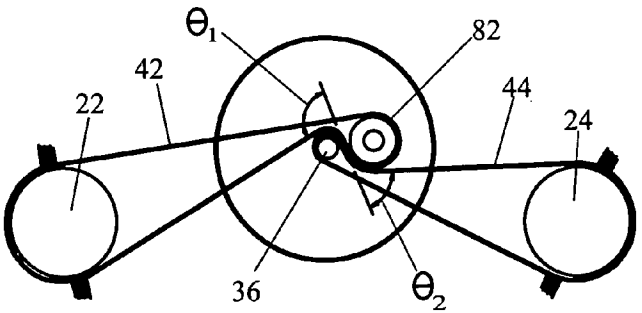

FIG. 5 Side view of a third alternative dual-belt system and motor 15.

DETAILED DESCRIPTION OF THE INVENTION

Manufacturing the disclosed dual-belt requires no new material or manufacturing techniques, as the belts, and pulleys currently used in the vacuum industry are sufficient. The disclosed invention can use standard vacuum drive belts, motors and pulleys.

In FIGS. 1 and 1A we see the disclosed dual-belt counter-rotating drive systems 20 and 40 being used in a vacuum cleaner and a floor scrubber, respectfully. Vacuum cleaner, floor scrubbers, rug shampooers and other rotary mechanical cleaning devices can be used with the disclosed invention. These prior art cleaning systems, and their construction, are well known and there is no need to discuss specific prior art designs because the disclosed dual-belt drive system can be incorporated into almost any vacuum cleaner, floor scrubber, carpet shampooer or other rotary brush cleaning machine with two or more counter rotating brushes.

In FIG. 1, the disclosed dual-belt drive system 20 is attached to a prior art upright style vacuum cleaner having a motor 15 (provides rotary power to drive system 20), a suction fan 17 driven by motor 15 for producing suction air, and a suction nozzle 18 for directing suction air to the floor near the rotary brushes 22 and/or 24 (Air Inlet 19). Drive system 20 can be used with dirty-air and clean-air vacuum cleaner systems, and may be driven by the same motor that drives the suction fan or be driven by a separate motor. Drive system 20 is powered by motor 15, which also drives the dirty-air style suction fan system 17 which pulls dirt-filled air through the fan itself. Dual-belt drive system 20 comprises support plate 30, pulley wheel 32, pulley shaft 34, drive shaft 36, rear belt 42 (first belt), rear rotary brush 22, front belt 44 (second belt), and front rotary brush 24. Drive shaft 36 can be driven directly by motor 15, or be driven through a gear system between the motor and drive shaft 36 to provide rotary power. Such a gear system could be used to provide a slower rotation rate for drive shaft 36 than would be possible if it were connected directly to the motor's drive shaft. Support plate 30 can be mounted directly to motor 15, or even be part of the motor's housing (pulley shaft 34 and pulley 32 mounted directly on the motor housing). Support plate 30 can also be mounted to the housing of the vacuum cleaner, but this would require additional structural support for the plate since the plate experiences substantial forces because of the tension in stretched belts 42 and 44 connected to it. Support plate 30 provides a hole near its center for drive shaft 36 to protrude through and a support post 34 to provide bearing support for pulley 32.

Support shaft 34 can be integral with support plate 34 and can be welded or bolted to plate 34. Pulley 32 is designed to rotate about support shaft 34. Roller bearings or other types of bearings may be used between shaft 34 and pulley wheel 32 to provide lower turning friction for the pulley. Two elastic belts 42 and 44 are used to transfer rotary power from drive shaft 36 to rotary brushes 22 and 24, respectfully. The front and rear rotary brushes 24 and 22, respectfully, can be standard OEM rotary brushes with brush strips 26 extending the length of the brush roller, one for each belt.

The elastic belts can be flat rubber belts that are standard for the vacuum industry. The flat and wide vacuum brush belts 42 and 44 are shown here because this allows the second belt to easily run on top of the first belt to transfer counter-rotating rotary motion. Alternatively, belts 42 and 44 can be specially shaped so that the interaction of their outside surfaces (exterior surfaces) can better transfer torque from belt 44 to belt 42. For example, Belts 42 and 44 may not be smooth on their outside surface, but can have interlocking teeth (or a textured surfaced) on their outside surface where they contact each other to provide a strong interaction engagement. Generally however, the friction created from the rubber to rubber contact is sufficient to transfer the needed torque from the first belt to the second belt. Belts 42 and 44 are generally stretched between ten and thirty percent of their length when placed on prior art shaft and brush pulley systems. This creates substantial tension within the belts, which is used to create a contact force between drive shaft 36 and belt 44, a contact force between belts 42 and 44, a contact force between belt 42 and rear brush 22, and a contact force between belt 44 and front brush 24. Belt 44 is positioned around a brush pulley 29 on front rotary brush 24 (see FIG. 1) and drive shaft 36. The outside of belt 44 engages belt 42 substantially at shaft 36 and at pulley 32 and to a lesser extent between shaft 36 and pulley 32. Belt 42 is positioned around a brush pulley 27 on rotary brush 22 and pulley 32, and the outside of belt 42 engages the outside of belt 44 substantially at shaft 36 and pulley 32. Tension within belts 42 and 44 during use provides sufficient friction at the interface between belts 42 and 44 to transfer sufficient rotary power from belt 44 to belt 42, and provide power to rear rotary brush 22. Pulley 32 is positioned to cause interference (engagement) between the outside surfaces of belts 42 and 44. This engagement causes the transfer of rotary power. Pulley 32 is positioned with respect to drive shaft 36 and brushes 22 and 24, so that the lower portion of belt 42 can ride over shaft 36. Pulley 32 may be placed on either above belt 44 (FIGS. 2,3, and 5) or below belt 44 (FIG. 4). The natural result of the outside surfaces of the belts engaging one another in this arrangement is that the belts rotate in opposite directions.

Belts 42 and 44 and their corresponding rotary brushes 22 and 24, respectfully, are shown rotating so that the brushes tend to sweep dirt and debris toward the underside of the vacuum cleaner. Thus the brushes provide a sweeping action where the brushes are sweeping toward each other. This helps in cleaning hard floors because it is more difficult for dirt to escape from under the vacuum if two counter-rotating brushes are continually sweeping it back under the vacuum where the suction air inlet is. The counter-rotating action can also be used for self-propelled operation as is shown in prior art, using a mechanism that alternately engage the front and rear brushes 22 and 24, to provide forward and reverse locomotion, respectfully. Such self-propelled systems can operate very smoothly with very little force needed from the user to move the vacuum.

In FIG. 1A we see dual-belt drive system 40 being used in a counter-rotating scrubber brush. This example shows that the axises of the rotary brushes can be vertical (i.e. FIG. 1A) or horizontal (i.e. FIG. 1). In FIG. 1A, dual-belt drive system 40 comprises, a motor 16, two belts 42 and 44, two brushes 46 and 48, and each brush with a drive pulley 47 and 49, respectfully. Construction of vertical-axis dual-belt drive 40 is essentially identical to dual-belt drive 20 seen in FIGS. 1 and 2, except the drive system has been rotated ninety degrees. Either of these drive system (vertical or horizontal) could be used for a carpet scrubber or shampooer. Both styles of scrubbers and shampooers presently exist on the market. The two counter rotating brushes 46 and 48 contact a surface being cleaned and substantially cancel torque created by the other, providing a floating feel to the scrubbers movement.

FIG. 2 shows a section-view of dual-belt drive system 20, seen in FIG. 1. The section cut goes though drive shaft 36, belts 42 and 44, rotary brushes 22 and 24, and pulley wheel 32 and pulley support 34. Pulley 32 is seen mounted on support peg 34 and is free to rotate around peg 34 to allow belt 42 to rotate counter-clockwise to drive rotary brush 22 counter-clockwise. Drive shaft 36 rotates clockwise in FIGS. 2 through 5, and drives belt 44 and front rotary brush 24 clockwise. From this side view we can see that the size and placement of pulley 32 in relationship to drive shaft 36 determines the interaction angles $\theta_1$ and $\theta_2$ at drive shaft 36 and pulley 32, respectfully, between belts 42 and 44. In FIG. 2 interaction angle $\theta_1$ is about forty-five degrees and interaction angle $\theta_2$ is about five degrees. Both these angle create a normal force pushing the outer surfaces of belts 42 and 44 together, which generates a friction force tangential to the surfaces to transfer rotary power between belt 44 and 42. Notice that if pulley 32 is lowered in FIG. 2 the interaction angles increase and so would the amount of tangential force (friction force) that could be transferred from belt 44 to belt 44. However, if pulley 32 is lower too far, the top portion of belt 42 will begin to rub against the bottom portion of belt 42 and the belt would burn-out due to friction. If pulley 32 is made larger, it can be lowered further in FIG. 2 and still prevent the inside surface of belt 42 from rubbing against itself. Also if pulley 32 is lowered to far, the inside surface of belt 44 will begin to rub. Other ways exist to increase these interaction angles, including moving pulley 32 closer to drive shaft 36 as seen in FIG. 3.

FIG. 3 shows a section-view of an alternative dual-belt drive system using a modified support plate 50. Motor 15, belts 42 and 44 and rotary brushes 22 and 24 are the same as in drive system 20. The difference between this drive system in FIG. 3 and drive system 20, is that pulley 32 and support post 34 has been replaced with a smaller diameter pulley shaft 52. Pulley shaft 52 is free to rotate and is mounted within a bearing structure within support plate 50. Generally, this configuration will weigh more than the configuration seen in FIG. 2, because of the relatively large bearing structure (not shown) that would be needed to support shaft 52. Notice that even though pulley 52 is considerably smaller than pulley 32, the interaction angles $\theta_1$ and $\theta_2$ are larger for this design. This is because pulley 52 is placed much closer to drive shaft 36 than pulley 32. The result is that the belts are bent at a sharper angle. If we take this to the extreme, pulley 52 would be so close to shaft 36 that there was just enough room for the two belts to pass between them. For the design in FIG. 3, angle $\theta_1$ is approximately eighty degrees and $\theta_2$ is approximately thirty degrees. This is a total angle change of one-hundred twenty degrees, and the greater the sum of the interaction angles $\theta_1$ and $\theta_2$ the greater the torque that belt 44 can transfer to belt 42 (for the same tension in the belts and the same friction coefficient between the belts). Notice that for the drive systems in FIGS. 1, 2, 3 and 5, belt 42 has a negative angle change $\theta_1$ as it goes over shaft 36 is in the clockwise direction. Also in FIGS. 1, 2, 3 and 5, belt 44 has a positive angle change $\theta_2$ as it goes under pulley 32, 32, 52, and 82, respectfully, in the counter-clockwise direction. In FIG. 4, belt 42 has a positive angle change $\theta_1$ as it goes under shaft 36 is in the counter-clockwise direction, while belt 44 has a negative angle change $\theta_2$ as it goes over pulley 72 in the clockwise direction.

FIG. 4 shows a section-view of another alternative dual-belt drive system using a modified support plate 70. Motor 15, belts 42 and 44 and rotary brushes 22 and 24 are the same as in drive system 20. The difference between this drive system in FIG. 4 and drive system 20, is that pulley 72 and support post 74 have been moved to a location below drive shaft 36. Pulley 72 and post 74 are physically identical to pulley 32 and post 34 in this example, just their location on mount 70 relative to drive shaft 36 is different. Pulley 72 is closer to shaft 36, so that the sum of angles $\theta_1$ and $\theta_2$ is larger then it was for drive system 20. Angle $\theta_1$ is approximately thirty degrees and $\theta_2$ is approximately seventy degrees. This gives a total interaction angle of approximately one-hundred degrees, significantly more than the approximately fifty degree total interaction angle for drive system 20. Note that this increase in total interaction angle is not because pulley 72 is placed below shaft 36, but instead because of the closer proximity of pulley 72 to shaft 36. Because of the placement of rotary brushes 22 and 24 below the drive shaft, the disclosed dual-belt drive system can ultimately have greater total interaction angles (absolute sum of $\theta_1$ and $\theta_2$) with the pulley above belt 44 (see FIG. 5). The reason for this is that the pulley can take advantage of the obtuse angle the belts make with the drive shaft when measuring above the drive shaft than going below it. Thus we see in FIG. 5, that a total interaction angle of one-hundred eighty degrees is possible. This is greater than the interaction angle of a standard vacuum belt mounted on a motor shaft in a standard vacuum which is approximately one-hundred fifty degrees around the motor shaft. These large interaction angles (contact angles) are overkill since the belts would normally be made of a rubber material or polymer, which has a very high coefficient of friction for contact with itself, and generally will be much higher than the coefficient of friction for the belt against the metal drive shaft 36.

In FIG. 5 we see an alternative placement for pulley 82 on essentially the same platform seen in FIGS. 2, 3 and 4. The angle $\theta_1$ is approximately one-hundred degrees while angle $\theta_2$ is approximately eighty degrees for a total interaction angle of one-hundred eighty degrees. Thus, with such a configuration the engagement of belts 44 and 42 will have more than sufficient friction between the rubber belts to transfer rotational energy from belt 44 to belt 42 (rubber on rubber friction can be very large).

One additional thing to note about these designs, is that belts 42 and 44 are not necessarily driven at the same linear speed. This is because the thickness of belt 44 changes the effective radius of the drive shaft 36 for belt 42, and belt 42 changes the effective radius of pulleys 32, 52, 72 and 82 seen in FIGS. 2, 3, 4, and 5, respectfully for belt 44. For example, in FIG. 2 we see belt 42 riding over shaft 36 with belt 44 between shaft 36 and belt 42. Belt 44 rotates with shaft 36 so that belt 42 effectively sees a shaft that is larger in radius by the thickness of belt 44. The shaft is rotating at the same rate for both belts, so belt 42 moves at a faster linear speed than belt 44, (belt 44 at a smaller effective radius). The exact opposite is true in FIG. 4, where belt 42 goes around pulley 72 on the inside radius, and belt 44 on the outside, thus if most of the contact friction occurs around pulley 72 then belt 42 would move more slowly than belt 44 as they goes around the pulley. Thus, there is a tendency for belt 44 to speed-up as it goes around shaft 36 and a tendency to slow-down when it goes around its pulley. These two tendencies can be adjusted to cancel one another with the belts sliding pass one another in the area between the pulley and the drive shaft (belts moving at different linear speeds). Note that once the belts enter a turn (drive shaft or pulley) they are substantially locked together by friction, so there is very little slippage between the belts while the belts are in radial contact with each other. The result of all this is that the differences in linear speed between belt 42 and 44 will depend on the diameters of the drive shaft and the pulley, and what level of frictional contact between the belts as they move around the drive shaft and the pulley. For the drive system seen in FIG. 2, most of the frictional contact between belts 42 and 44, occurs around drive shaft 36, thus belt 42 will tend to move at a greater linear speed than belt 44 because the contact angle of belt 42 against belt 44 at pulley 32 is too small to effectively slow belt 42 down after being sped-up at drive shaft 36. In FIG. 4 the opposite is true. The frictional contact between belt 42 and belt 44 is strongest as the belts rotate around pulley 72. The contact angle of belt 42 on the outside surface of belt 44 at drive shaft 36 is relatively small compared to the contact angle at pulley 72, thus belt 42 will tend to move more slowly than belt 44 because of the greater friction at pulley 72.

Operational Description—FIGS. 1 through 5

All the examples of dual-belt drive systems disclosed here operate in essentially the same way. That is, a drive shaft provides the rotary power for the dual-belt drive system and engages belt 44 directly. Note that FIGS. 1,2,3,4, and 5 are viewed from the side with shaft 36 rotating clockwise when viewed from the side. As shaft 36 turns clockwise, belt 44 turns clockwise with it. Belt 44 also engages rotary brush 24 at brush pulley 29 so that friction contact between belt 44 and pulley 29 causes brush 24 to turn clockwise (as seen from the perspective of the drawings). The outer surface of belt 44 engages the outside surface of belt 42 and imparts locomotion to belt 42 through friction contact. This friction contact between belts 44 and 42 causes belt 42 to rotate counter-clockwise around its pulley (see pulleys 32, 52, 72, and 82) and rotary brush 22. In this way, belt 42 engages brush pulley 27 and turns rotary brush 22 in a counter-clockwise direction. At the same time belt 44 is driven by drive shaft and turns brush pulley 29 and rotary brush 24 in a clockwise direction. Friction between the drive shaft and the interior surface of belt 44 allows the transfer of power from shaft 36 to belt 44, and friction between the exterior (outside surface) of belt 44 and belt 42 allows the transfer of power from belt 44 to belt 42.

FIG. 1 shows a vacuum cleaner using the disclosed dual-belt drive system to drive two rotary brushes 22 and 24 in counter-rotating directions along horizontal axises. Belts 42 and 44 engage and move brushes 42 and 44, respectfully. The brushes rotate so dirt and debris are pushed inward under the vacuum head toward the suction air inlet. The user simply pushes and pulls on the vacuums handle to move the brushes across the surface being cleaned.

FIG. 1A shows a floor scrubber using the disclosed dual-belt drive system to drive two counter-rotating brushes 46 and 48 along vertical axises. Belts 42 and 44 move and engage pulleys 47 and 49 on brushes 46 and 48, respectfully. The scrubber rides on brushes 46 and 48 as they rotate to provide a floating effect. A similar drive system could be used for a shampooer.

In FIGS. 2, 3, and 5, drive shaft 36 engages belt 44 which engages and drives brush 24 in a clockwise direction as shown. The outside surface of belt 42 engages the outside surface of belt 42 as they curve around shaft 36 together.

Tension in the belts creates friction contact between belts 44 and 42 as they rotate around the drive shaft and pulley together and thereby providing the transfer of rotary motion from belt 44 to belt 42. Pulley 32 (pulley 52 in FIG. 3, pulley 82 in FIG. 5) is positioned relative to drive shaft 36 to provide this friction contact between belts 44 and 42. This transfer of motion causes belt 42 to rotate counter-clockwise around pulley 32 (or pulley 52 or 82) and brush 22. Thus, the friction contact between belts 42 and 44 cause rotary brushes 22 and 24, respectfully, to rotate in opposite directions (counter-rotating brushes). Pulley 32 (or pulley 52 or 82) is mounted relatively high with respect to shaft 36 so that there is clearance between the upper portion of belt 42 and the top of drive shaft 36.

In FIG. 2, the geometry of the belts, drive shaft, and pulley result in belt 42 traveling at a greater radius around shaft 36 than does belt 44. This greater radius means that belt 42 will have a greater linear speed than belt 44. Thus, brush 22 will tend to rotate faster than brush 24 if both brushes have the same diameter brush pulley (see brush pulleys 27 and 29 respectfully, in FIG. 1). Thus, to provide both rotary brushes 22 and 24 with substantially the same rotational speed, the greater linear speed of belt 42 must be compensated for. One way to do this is to make pulley 29 on rotary brush 24 slightly smaller in diameter than pulley 27 on rotary brush 22. This effectively provides a greater speed ratio for rotary brush 24 and causes brush 24 to turn faster and match the rotational speed of brush 22. In most cases, this slight difference in rotational speed of the belts and rotary brushes is unimportant. However, for some designs it will be important to compensate for the speed difference between belts 42 and 44 and rotary brushes 22 and 24, respectfully.

In FIG. 4, drive shaft 36 engages belt 44, which drives brush 24 in a clockwise direction as shown. The outside surface of belt 44 engages the outside surface of belt 42 as it curves around pulley 72. Tension in the belts creates friction between belts 44 and 42 as they rotate around pulley 72 and shaft 36 to provide the transfer of rotary motion from belt 44 to belt 42. This transfer of motion causes belt 42 to rotate counter-clockwise around pulley 72 and brush 22. Thus, brushes 22 and 24 rotate in opposite directions. Pulley 72 is mounted relatively low with respect to shaft 36 so that belt 42 runs under shaft 36. Because the greatest friction occurs between belts 42 and 44 as they pass around pulley 72, and belt 42 travels at a smaller radius around pulley 72 than does belt 44, belt 42 will tend to have a smaller linear speed than belt 44. Thus, brush 22 will tend to rotate slower than brush 24 given they have the same diameter where their belts connect.

In FIG. 4, the geometry of the belts, drive shaft, and pulley result in belt 42 traveling at a smaller radius around pulley 72 than does belt 44. This smaller radius means that belt 42 will have a smaller linear speed than belt 44. Thus, brush 22 will tend to rotate slower than brush 24 if both brushes have the same diameter brush pulley (see brush pulleys 27 and 29 respectfully, in FIG. 1). Thus, to provide both rotary brushes 22 and 24 with substantially the same rotational speed, the greater linear speed of belt 44 must be compensated for. One way to do this is to make pulley 27 on rotary brush 24 slightly smaller in diameter than pulley 29 on rotary brush 22. This effectively provides a greater speed ratio for rotary brush 22 and causes brush 22 to turn faster and match the rotational speed of brush 24.

In FIG. 5, The contact angles for the outside belt around drive shaft 36 (belt 42) and pulley 82 (belt 44) are about the same. However, because drive shaft 36 has a considerably smaller diameter than pulley 82, the thickness of belt 44 around shaft 36 has a greater effect on the speed of belt 42, than the thickness of belt 42 around pulley 82 has on the speed of belt 44. These two speed differences are competing against each other and may be optimized to result in substantially identical linear speeds for belts 42 and 44.

RAMIFICATIONS, AND SCOPE

The dual-belt counter-rotating drive system provides a very robust, impact tolerant and light-weight drive system for powered cleaning tools, such as, dual rotary brush vacuum cleaners, dual brush floor scrubbers, and dual brush dry carpet shampooers. The drive system requires no gears that can break in the harsh environment seen by vacuum cleaners, scrubbers and shampooers. Although the above description of the invention contains many specifications, these should not be viewed as limiting the scope of the invention. Instead, the above description should be considered illustrations of some of the presently preferred embodiments of this invention. For example, more belt drives can be added to drive additional rotary brushes on any of these systems. The disclosed drive system can include additional belts and pulley combinations which engage one of the existing belts (i.e. belt 42 or 44) to provide transfer of rotary power to the new belt. For example, if an additional pulley can be placed below drive shaft 36 in FIG. 4, so that it engages the lower portion of belt 42 and a third belt rotating around that third pulley would engage the outside surface of belt 42 to transfer power to the third belt and any rotary device connected to it. Thus, power would be transferred from drive shaft 36 to belt 44, from belt 44 to belt 42, and finally from belt 42 to the third belt, thereby driving all three belts. Another example is that pulleys 32, 52, 72, and 82 are all shown with their rotational axises parallel to drive shaft 36. While this is good if one wants the rotary brushes to have parallel axises, however if the brushes do not have parallel axises, it may be desirably to mount the pulley at an angle with respect to the drive shaft to help direct the belts to the angled brushes. Also, only flat rubber belts are shown in this document, but special shapes can be used to keep the belts aligned on the pulleys and shafts. The outside surface of the belts may also be textured or define teeth to increase maximum friction force and power transfer between the belts. Also, the drive shaft and/or pulley may be spring loaded to provide the desired tension on the belts. Also, the drive shaft and pulley may be placed so close together that belts 42 and 44 are compressed together as they squeeze between the shaft and pulley. In this way, friction force could be generated by the compression of the belts between the shaft and pulley. Also, additional pulleys can be added to the basic dual-belt system to manage angles on the belts and/or increase the total interaction angle, and/or etc. And finally, there exists many ways of supporting the pulley and drive shaft (two shown in this document), which can provide long-life bearing support under belt tension.

Thus, the scope of this invention should not be limited to the above examples but should be determined from the following claims.

I claim:

1. A belt drive system for a mechanical cleaning device, comprising:

a) a first belt comprising an inside and an outside surface;

b) a second belt comprising an inside and an outside surface;

c) a drive shaft for supplying rotary power;

d) a first output pulley and a second output pulley for utilizing rotary power;

e) a pulley mounted adjacent the drive shaft;

f) wherein the inside surface of the first belt engages the drive shaft and the first output pulley;

g) wherein the inside surface of the second belt engages the pulley and the first output pulley;

h) wherein the outside surface of the first belt is placed in friction contact the outside surface of the second belt, wherein rotary power is transferred by friction contact from the first belt to the second belt;

i) wherein the second output pulley rotates in substantially the opposite direction as the first output pulley.

2. The belt drive system in claim 1, wherein the pulley is mounted with respect to the drive shaft, whereby the first belt makes contact with greater than one-hundred eighty degrees of the drive shaft.

3. The belt drive system in claim 1, wherein the mechanical cleaning device is a upright style vacuum cleaner.

4. The belt drive system in claim 3, wherein the first and second output pulleys are mounted directly to a first and second rotary brush, respectfully, for agitating a surface, wherein the opposing rotation of the output pulleys cause the first and second rotary brushes to rotate in substantially opposite directions, such that the direction of rotation of both the first and second rotary brushes tends to push dirt and debris toward the area between the first and second rotary brushes.

5. The belt drive system in claim 1, wherein the mechanical cleaning device is a wet floor scrubbing device.

6. The belt drive system in claim 1, wherein the mechanical cleaning device is a rug shampooer.

7. The belt drive system in claim 1, further including a third belt, a second pulley, and a third output pulley, wherein the third belt comprising an inside and outside surface; wherein the inside surface of the third belt engages the second pulley and the third output pulley; wherein the outside surface of the third belt makes friction contact with either the outside surface of the first belt or the outside surface of the second belt for transferring rotary power to the third output pulley.

8. The belt drive system in claim 1, wherein the axis of said pulley is mounted parallel to the axis of said drive shaft.

9. The belt drive system in claim 1, wherein the axis of said pulley is mounted at an angle to the axis of said drive shaft.

10. A belt drive system for a mechanical cleaning device, comprising:

a) a first belt, and a second belt;

b) a drive shaft for supplying rotary power;

c) a pulley mounted adjacent said drive shaft;

d) wherein the first belt engages the drive shaft and a first rotary brush;

e) wherein the second belt engages the pulley and a second rotary brush;

e) wherein the first belt engages the second belt by friction contact;

f) wherein rotary power from the drive shaft is transferred by friction contact to the first belt and then transferred by friction contact from the first belt to the second belt, wherein the first and second rotary brushes are driven in opposite directions by friction contact with the first and second belts, respectfully.

11. The belt drive system in claim 10, wherein the pulley has a larger diameter than the drive shaft.

12. The belt drive system in claim 10, further including a first brush pulley defined on the first rotary brush for engaging the first belt, and a second brush pulley defined on the second rotary brush for engaging the second belt, wherein the diameter of the first brush pulley is smaller than the second brush pulley, whereby the rotational speeds of first and second rotary brushes are substantially equal.

* * * * *